United States Patent [19]

Giometti

[11] 4,395,923

[45] Aug. 2, 1983

[54] ENGINE STARTER GEARING

[75] Inventor: Paul F. Giometti, Horseheads, N.Y.

[73] Assignee: Facet Enterprises, Inc., Tulsa, Okla.

[21] Appl. No.: 282,112

[22] Filed: Jul. 10, 1981

Related U.S. Application Data

[63] Continuation of Ser. No. 85,092, Oct. 15, 1979, abandoned.

[51] Int. Cl.[3] ..... F02N 15/06

[52] U.S. Cl. ..... 74/7 R; 192/114 R

[58] Field of Search ..... 74/6, 7 R, 7 A; 192/114 R

[56] References Cited

U.S. PATENT DOCUMENTS

| | | | |
|---|---|---|---|
| 2,747,414 | 5/1956 | Cromwell et al. | 74/7 R |
| 2,796,766 | 6/1957 | Sabatini | 74/7 R |
| 2,901,912 | 9/1959 | Digby | 74/7 R |
| 2,902,864 | 9/1959 | Digby | 74/7 R |
| 2,922,307 | 1/1960 | Buxton | 74/7 R |
| 2,933,926 | 4/1960 | Buxton et al. | 74/7 R |
| 2,979,961 | 4/1961 | Spencer | 74/7 R |
| 2,996,924 | 8/1961 | Sabatini | 74/7 R |
| 3,222,938 | 12/1965 | Digby | 74/7 R |
| 4,194,412 | 3/1980 | Boyer | 192/114 R X |

*Primary Examiner*—Alfred C. Perham
*Assistant Examiner*—David J. Thomas
*Attorney, Agent, or Firm*—Remy J. VanOphem

[57] ABSTRACT

An engine starter drive adapted to engage an engine ring gear having a tooth driving clutch member which cooperates with a tooth driven clutch member. The driven clutch member further comprises a helical screw shaft with two circular grooves. A control nut threadably mounted on the screw shaft has a spring loaded detent which engages the circular grooves. The control nut is connected to the pinion gear by means of a retaining cup. Rotating the screw shaft causes the control nut to move along the screw shaft to traverse the pinion into mesh with the engine ring gears and crank the engine. When the engine fires, the acceleration of the pinion causes the control nut to move back on the screw shaft until the detent engages the first circular groove. After the engine starts and the pinion rotates to a predetermined speed, the detent withdraws from the first groove in the screw shaft and the control nut withdraws the pinion gear from engaging the engine ring gear. The detent then engages a second groove in the screw shaft to prevent undesired meshing of the pinion to the ring gear. If, during the engine cranking mode, the excessive torque is transmitted to the pinion gear by the ring gear, the driven clutches move away from the ring gear to compress a spring and resilient member to permit movement of the clutch members along splines coupling the driving clutch member to the power shaft and thereby absorb this torque by the resilient member. Indexing means also is provided to rotate the pinion gear to clear any abutment with the engine ring gear and causes the pinion gear to mesh with it.

10 Claims, 3 Drawing Figures

ENGINE STARTER GEARING

This is a continuation, of application Ser. No. 085,092, filed Oct. 15, 1979, now abandoned.

BACKGROUND OF THE INVENTION

1. Field of the Invention

The present invention relates to engine starter gearing, and more particularly to a starter drive of the type in which the gearing is automatically engaged and maintained in mesh until the engine has attained a sufficient rotary speed to indicate that it is reliably self-operative and further of the type in which the gearing is automatically maintained out of mesh after the engine has been started.

2. Description of the Prior Art

In starter gearing of this character, it is necessary to provide some form of overrunning connection between the drive pinion and the starting motor in order to prevent acceleration of the starting motor to excessive speeds when the engine becomes self-operative, and also to avoid having the starter motor act as a load on the engine during the initial period when the engine cylinders start firing. Various types of overrunning clutches have been and are employed for this purpose, but it has been found that the type which employs clutch members having interengaging teeth which are wedged together by screw jack action under load is in many respects the most satisfactory. The screw jack action is provided by a hollow screw shaft with a three (3) start helical splines machined therein. This hollow screw shaft is mounted on a driving sleeve which is in turn connected to the drive shaft.

In prior art devices, the overrunning function is provided by milling a notch in the center helical thread of the screw shaft and milling a notch so that a detent may engage this notch and stop the control nut from being driven backwards (away from the engine ring gear) after the engine has been started. The assembly of the control nut to the screw shaft is simplified by the fact that there are only three helical threads which provide the screw jack action. In assembly, the detent is merely lined up with the middle helical thread containing the notch so as to insure that the starter drive will function properly and allow the detent to engage this notch during the specific mode of operation mentioned above.

The machining of the helical spline on the hollow screw shaft and the detent notch adds a great deal of expense to the total cost of the shaft. To reduce this expense, it was determined to change the screw shaft helical spline to a 15 start spline which could then be manufactured by rolling the thread onto the screw shaft sleeve at the same time that the sleeve was being manufactured on a screw machine. This reduced the cost of the sleeve as well as the overall cost of the starter drive. However, the 15 start helical thread presented a first difficult problem for the location and milling of the detent notch. In addition, a second difficult assembly problem, was also presented in that, the assembler must align the detent of the control nut with the helical thread, the detent notch is located on, in order to insure proper functioning of the starter drive. Unless the detent is started on the same thread having the detent notch, the control nut will not properly engage the detent notch and, therefore, the starter will not function according to its intended use. In addition, the determination of whether the detent in the control nut had been properly started on the correct thread could not be made until after the sub-assembly was complete. This resulted in a considerable number of sub-assemblies being rejected and torn down for reassembly because the detent in the control nut was not properly aligned with the detent notch on the 15 start helical spline of the screw shaft.

BRIEF DESCRIPTION OF THE INVENTION

The present invention is directed to an engine starter drive of the "folo-thru" type which incorporates a circular groove on the screw shaft all the way around the outside of the screw shaft in order to eliminate the need to line up the detent with the detent notch. The groove necessarily is sharp stepped on the backside to prevent the detent from climbing out of the groove and tapered at the frontside allowing the detent to climb out of the groove when the starter drive is in the meshed position. The screw shaft is, therefore, allowed to move away from the ring gear and compress the rubber cushion under shock loading conditions. If the pinion gear and control nut assembly attempts to move back out of mesh prematurely, the detent will fall back into the circular detent groove and move against the perpendicular backside or stepped backside of the groove preventing demeshing until sufficient centrifugal force acts on the detent to overcome the spring force holding the detent in the groove, thereby allowing the pinion to disengage from the ring gear.

An antidrift groove is further provided in the starter drive to prevent the control nut from traversing the screw shaft after the engine has been started and the starter pinion gear has been disengaged by the engine ring gear overrunning the pinion gear. The antidrift groove cooperates with the detent to prevent the control nut from travelling along the helical thread to abut the ring gear while the engine is running.

It is an object of the present invention to provide a novel engine starter drive of the above type incorporating means for preventing demeshing of the pinion gear from the engine gear below a predetermined speed which requires simple machining operations and avoids unnecessary rework due to misalignment between the detent and the detent notch in the screw shaft.

It is a further object of this invention to provide a novel engine starter drive of the above type which incorporates means for preventing the pinion from drifting into engagement with the engine ring gear below a predetermined rotation speed.

Still a further object of this invention is to provide a novel engine starter drive which is simple to assemble and economical in construction and eliminates the need of an expensive milling operation by permitting the incorporation of the antidrift notch and detent notch to the screw shaft during the screw machine operation.

Further objects and advantages will be apparent from the following description taken in connection with the accompanying drawings.

DETAILED DESCRIPTION OF THE PREFERRED EMBODIMENT

Figure 1:
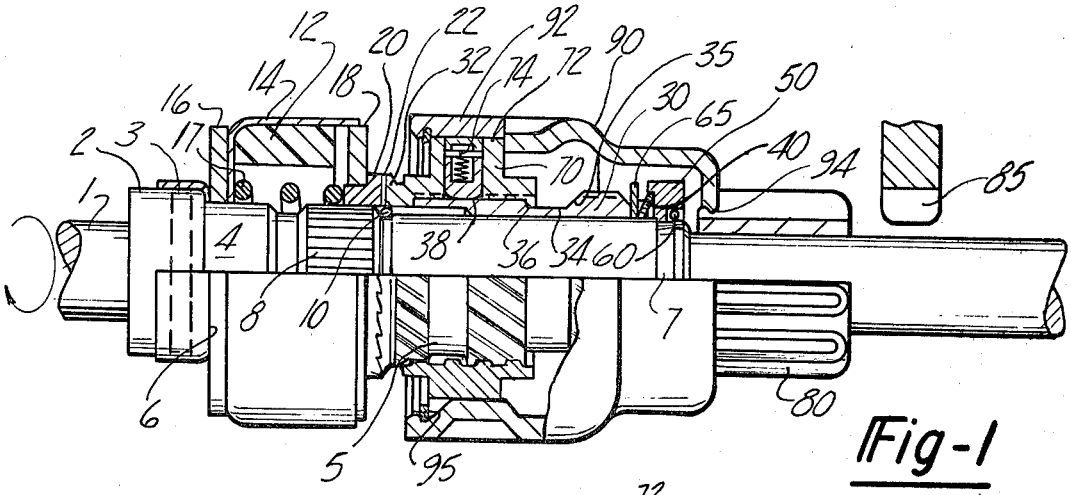
FIG. 1 is a side elevation view partly broken away and in section, showing a preferred embodiment of the invention with the parts in the idle condition.

In FIG. 1 of the drawing, there is illustrated a power shaft 1 on which a hollow sleeve 2 is fixably mounted by suitable means such as a cross pin 3. The sleeve 2 is provided with a reduced diameter portion 4 defining a radial shoulder and straight splines 8 on which a driving clutch member 20 is slidably but nonrotatably mounted. A retainer ring 10 prevents the driving clutch sleeve from disengaging from the spline 8 in one direction away from the cross pin 3.

The drawing clutch member 20 is yieldably mounted to the sleeve 2 by means of a resilient member 12 contained in a cup-shaped housing 14. The cup-shaped housing is mounted on the reduced diameter portion 4 of the sleeve 2 against the radial shoulder 6 with a bearing washer 16 therebetween. A spring 17 is mounted on the reduced diameter portion 4 between the radial portion of the cup-shaped housing 14 and the driving clutch member 20. The spring 17 maintains an axial force on the driving clutch member 20. The spring 17 maintains an axial force on the driving clutch member 20. Thus, the spring 17 resists movement of the clutch member 20 along the splines 8 in the direction towards the cross pin 3. A thrust collar 18 mounted to the driving clutch member 20 is intended to engage the elastically deformable resilient member 12 so that excessive axial movement of the driving clutch member 20 toward the cross pin 3 will also be resisted by the elastically deformable resilient member 12.

The driving sleeve 2 has a second reduced diameter portion 5 upon which is slidably mounted a hollow screw shaft or driven clutch member 30. The driven clutch member 30 is slidably journaled on the reduced diameter portion 5 of the sleeve 2 and is provided with overrunning clutch teeth 32 arranged to cooperate with similar overrunning clutch teeth 22 on the driving clutch member 20. The engagement of the driven and driving clutch member teeth, being normally maintained by a spring washer 40, interposed the one end of the driven clutch member 30 and a stop ring 50 axially fixed on the second reduced diameter portion 5 near the one end of the driving sleeve 2 by means of retainer ring 60. A circumferential groove 7 is formed on the one end of the driving sleeve and contains the retainer ring 60 which securely locks the stop ring 50 axially on the driving sleeve 2. A thrust washer 65 is preferably interposed between the one end of the driven clutch sleeve member or the hollow screw shaft 30 and the stop ring 50.

A pinion 80 is slidably mounted on the power shaft 1 adjacent to one end of said driving sleeve 2 for movement into and out of mesh with the ring gear 85 of the engine to be started. A control nut 70 is threaded on the driven clutch sleeve member 30. The control nut 70 further has a radial lug 72 which is received in a slot 92 adjacent to the open end of the retaining cup 90. The radial lug 72 is retained in the retaining cup 90 by means of a lock ring 95 positioned in a groove near the open end of the retaining cup 90. The opposite end of the retaining cup is rigidly connected to the pinion 80 as indicated at 94. The movement of the control nut 70 and the driving member 30 away from driving clutch member 20 is limited by the thrust washer 65 and the spring washer 40.

Figure 2:
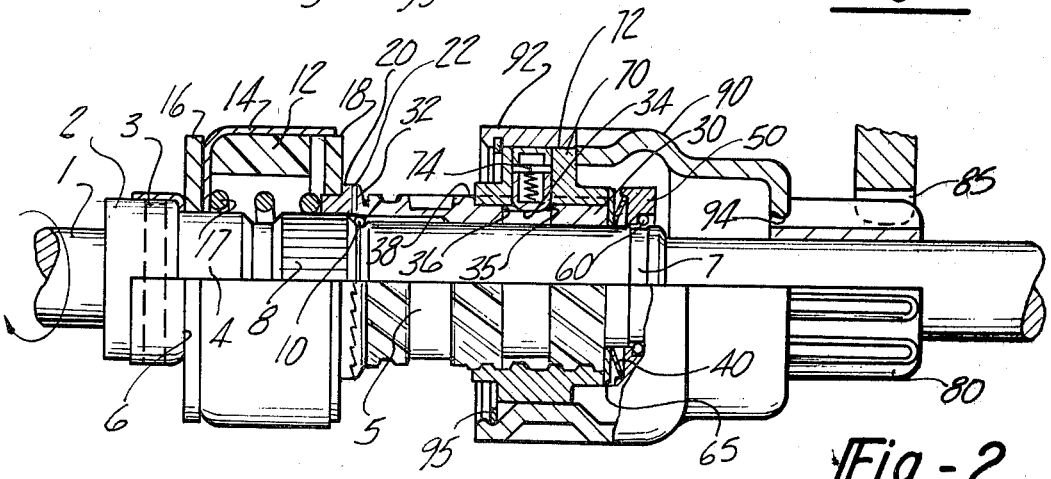
FIG. 2 is a view similar to FIG. 1 showing the parts in the engine cranking position.

The demeshing of the pinion 80 from the ring gear 85 is prevented until a successful start has occurred by a spring pressed detent 74 in the lug 72. The detent 74 is mounted for radial sliding movement in the control nut 70 and for bearing on the periphery of the driven clutch sleeve member 30. The screw shaft 30 has a circular groove 34 positioned to receive the detent 74 when the pinion 80 approaches the meshed condition with the ring gear 85 as shown in FIG. 2. The groove 34 is tapered 35 adjacent the one end near the pinion 80 allowing the detent 74 to climb out of the groove 34 when the pinion 80 is moved into mesh with the ring gear 85. The groove 34 is sharp stepped 36 on the other side to prevent the detent 74 from climbing out of the groove 34 until the pinion 80 and the retaining cup 90 are rotated by the ring gear 85 at a predetermined speed to withdraw the detent 74 out of the groove 34 by centrifugal force.

The screw shaft 30 is also provided with an inclined shoulder circular groove 38 in position to receive the detent 74 to prevent the control nut 70 from drifting away from the idle position shown in FIG. 1.

In operation, starting with the assembly as shown in FIG. 1, rotation of the power shaft 1 in the direction of the arrow is transmitted through the sleeve 2, to driving clutch member 20 and thus to the screw shaft of driven clutch member 30. The inertia of the retaining cup 90 and control nut 70 assembly causes the control nut 70 to move along the driven clutch sleeve helical spline to traverse the pinion 80 into mesh with the ring gear 85. Any further travel of the control nut is arrested by the thrust washer 65 as shown in FIG. 2. Further rotation of the power shaft causes cranking torque to be transmitted to the ring gear in order to start the engine.

Figure 3:
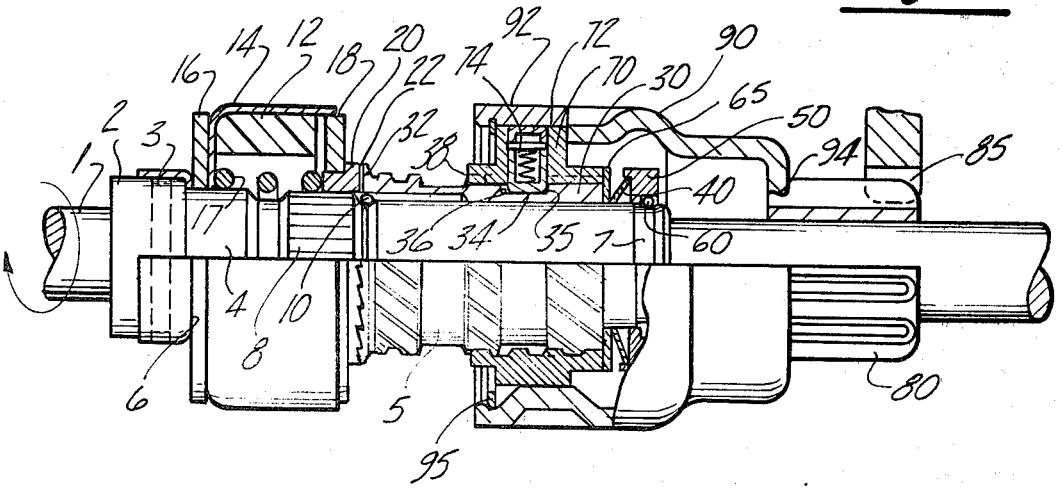
FIG. 3 is another similar view showing the parts in the positions assumed when the engine becomes self-operative while the drive pinion is held in mesh with the engine ring gear.

When the engine fires, the acceleration of the pinion 80 causes the control nut 70 to move back on the screw shaft 30 until the detent 74 is stopped by the sharp step 36 in the groove 34 as shown in FIG. 3.

When a successful start is secured, the acceleration of the pinion 80 to a predetermined speed causes the detent 74 to withdraw from the groove 34 in the screw shaft 30. Thus, the control nut 70 traverses towards the driven clutch member 20 and the assembly is returned to the idle position as shown in FIG. 1. The undesired remeshing of the pinion to the ring gear is prevented by the engagement of the detent 74 with the groove 38 on the screw shaft.

If during the traversing mode of the control nut 70 along the screw shaft 30, towards the ring gear 85 the pinion gear 80 does not engage the engine ring gear 85 but merely abuts the ring gear 85, an indexing means is provided to rectify this condition. The indexing means permits the control nut 70 to be rotated on the helical splines with respect to the driving clutch sleeve member 30. In the abutting condition, the control nut 70 moves rearward towards the cross pin 3, which causes the screw shaft 30 to compress the spring 17 and the resilient member 12. The driving clutch member 20 moves axially rearward towards the cross pin 3 because the member 20 is mounted to the sleeve 2 by straight splines 8. As discussed previously, the retainer ring 10 prevents the driving clutch sleeve 20 from disengaging the sleeve 2 when the clutch member 20 is urged toward the ring gear. The control nut 70 is rotated and travels along the helical splines thereby causing the pinion gear 80 to clear the abutment with the engine ring gear 85. This permits the pinion gear 80 to mesh with and engage the engine ring gear 85 to start the engine.

If, after the initiation of the cranking operation and excessive torque is applied to the pinion 80 by the ring gear 85, the coupling members 20, 30 move rearward along the power shaft to compress the spring 17 and the resilient member 12. This rearward movement permits the movement of the driving clutch member 20 along the straight splines 8 in the direction towards the cross pin 3. On the other hand, the driven clutch member 30 continues to rotate relative to the driving clutch member 20 thus allowing the teeth 22, 32 to slip past each other.

Although but one embodiment of the invention has been shown and described in detail, it will be understood that changes may be made in the design and arrangement of the assembly without departing from the spirit of the invention.

What I claim is:

1. A starter drive adapted to engage the ring gear of an engine, said engine starter comprising:

a power shaft;

an annular sleeve member mounted on said power shaft for rotation therewith;

overrunning clutch means mounted on said annular sleeve member, said overrunning clutch means comprising a driving clutch member mounted to said annular sleeve member for rotation therewith and an annular driven clutch member slidably and rotatably mounted to said annular sleeve member; said driving clutch member further being axially slidable on said annular sleeve member, said driven clutch member further having at least one circular groove in an outer surface;

a pinion gear member juxtaposed said annular sleeve member, said pinion gear member being axially and rotatably movable with respect to said annular sleeve member;

means for traversing said pinion gear into mesh with said engine ring gear, said traversing means being responsive to the acceleration of said power shaft such that when said ring gear rotates below a predetermined speed said pinion gear moves into mesh with said ring gear and moves said ring gear to start said engine, said pinion gear further demeshing from said ring gear when said ring gear rotates above said predeterminate speed; and means for preventing demeshing of said pinion gear from the engine ring gear below said predetermined ring gear rotation speed; said preventing means cooperating with said at least one circular groove of said driven clutch member to prevent demeshing of said pinion gear from said engine ring gear below said predetermined ring gear rotation speed; whereby said pinion gear is accelerated by said power shaft to traverse along said power shaft into mesh with the engine ring gear so as to start the engine, said pinion gear being prevented from demeshing from said ring gear below said predetermined ring gear rotation and further demeshing from said ring gear above said predetermined ring gear rotation speed.

2. An engine starter drive as claimed in claim 1 further comprising:

anti-drift means, located in said annular sleeve member, for preventing said pinion gear from traversing into mesh with the engine ring gear when said power shaft is at rest; and means, for indexing said pinion gear, said indexing means mounted on said annular sleeve member so that when said pinion gear abuts the engine ring gear, said indexing means rotates said pinion gear to clear the abutment with the engine ring gear and thereby permit engagement of said pinion gear with the engine ring gear.

3. An engine starter drive adapted to engage an engine ring gear, said starter drive comprising:

a power shaft;

a hollow sleeve member mounted on said power shaft, said sleeve member being fixed to said power shaft at one end;

a driving clutch member coaxially mounted on said hollow sleeve;

a driven clutch member coaxially mounted on said hollow sleeve adjacent to said driving clutch member for cooperation therewith; said driven clutch member having a first circular groove proximate to one end;

a control nut threadably mounted on said driven clutch member;

a pinion gear slidably mounted on said power shaft juxtaposed said hollow sleeve member;

a retaining cup connected to said control nut at one end and to said pinion gear at an opposite end;

a stop collar fixedly mounted to the opposite end of said hollow sleeve member to limit the axial movement of said control nut on said driven clutch member;

anti-drift means for preventing engagement of said pinion gear with the engine ring gear when said pinion gear is at rest;

means, responsive to the acceleration of said pinion gear, for moving said pinion gear into mesh with the engine ring gear, said moving means transmitting torque from said driving clutch member to the engine ring gear so as to crank the engine to be started; and means, cooperating with said first circular groove, for preventing demeshing of said pinion gear from the engine ring gear below a predetermined speed of the ring gear.

4. An engine starter drive as claimed in claim 3 further comprising:

means, located on said driven clutch member for indexing said pinion gear so that when said pinion gear abuts the engine ring gear, said indexing means rotates said pinion gear to clear the abutment with the engine ring gear and to permit the engagement of said pinion gear with the engine ring gear.

5. An engine starter drive as claimed in claim 3 wherein said anti-drift means comprises a second circular groove located on said driven clutch member adjacent to said driving clutch member and a spring loaded detent mounted in said control nut, said spring loaded detent further engaging said second circular groove when said pinion gear is at rest.

6. An engine starter drive in claim 5 further comprising:

means, mounted on said annular driven clutch member, for indexing said pinion gear to engage the engine ring gear when said pinion gear abuts the engine ring gear so that said indexing means rotates said pinion gear to clear the abutment and traverses said pinion gear into engagement with the engine ring gear.

7. An engine starter drive as claimed in claim 6 wherein said means for preventing demeshing means further comprises:

a screw thread on said annular driven clutch member, said screw thread having said first circular groove therein and wherein said control nut further having a spring loaded detent for cooperation with said first circular groove below a predetermined pinion gear rotation speed.

8. An engine starter drive adapted to engage an engine ring gear comprising:

input means;

an annular sleeve member mounted to said input means;

an overrunning clutch mounted to said annular sleeve member, said overrunning clutch having an annular driven clutch member and an annular driving clutch member for cooperative engagement therewith;

a pinion gear mounted adjacent to said annular sleeve member;

means, responsive to the acceleration of said input means, for moving said pinion gear into engagement with the engine ring gear when said ring gear rotates below a predetermined speed;

means for rotating said pinion gear to crank the engine to be started when said pinion gear is interengaged with the engine ring gear; and means, mounted on said annular driven clutch member, for preventing the disengagement of said pinion gear from the engine ring gear below a predetermined ring gear rotation speed, said disengagement preventing means comprising a circular groove located adjacent the one end in said annular driven clutch member, said circular groove having a tapered end adjacent to said pinion gear, a sharp stepped end opposite said tapered end, and detent means, cooperating with said sharp stepped end, for preventing said detent means from withdrawing from said circular groove when the engine fires so as to accelerate said pinion gear thereby preventing said pinion gear from traversing out of mesh with the engine ring gear below said predetermined rotational speed of the ring gear.

9. An engine starter drive for engaging an engine ring gear, said starter drive mounted on a power shaft, said engine starter drive comprising:

a pinion gear slidably mounted on said power shaft to cooperatively engage the engine ring gear;

an annular sleeve member mounted on the power shaft for rotation therewith, said annular sleeve member having one end adjacent to said pinion gear;

a driving clutch member slidably connected to said annular sleeve member for rotation therewith, said driving clutch member having a first end;

a driven clutch member mounted on said annular sleeve member adjacent to said first end of said driving clutch member, said driven clutch member having one end and an opposite end, said driven clutch member further having a first circular groove adjacent said one end and a second circular groove adjacent said opposite end;

clutch means, between said driving clutch member and said driven clutch member, for providing a rotational coupling therebetween in one direction of rotation and for providing an overrunning coupling therebetween in an opposite direction of rotation;

a control nut threadably mounted on said driven clutch member;

detent means, integral with said control nut and engaging said first circular groove, for preventing said detent means from withdrawing from said first circular groove below a predetermined rotational ring gear speed when the engine fires so as to accelerate said pinion gear;

mean, responsive to the rotation of the power shaft, for moving said pinion gear into mesh with the engine ring gear and for transmitting torque from the power shaft to the engine ring gear so as to crank the engine to be started; and anti-drift means, cooperatively engaging said second circular groove, for preventing said pinion gear from moving axially along the power shaft into mesh with the engine ring gear when the power shaft is at rest.

10. An engine starter drive for engaging an engine ring gear to start the engine, said starter drive mounted on a power shaft, said engine starter drive comprising:

a pinion gear slidably mounted on the power shaft to cooperatively engage the engine ring gear;

an annular sleeve member mounted on the power shaft for rotation therewith, said annular sleeve member having one end adjacent to said pinion gear;

a driving clutch member slidably connected to said annular sleeve member for rotation therewith, said driving clutch member having a first end;

a driven clutch member mounted on said annular sleeve member adjacent to said first end of said driving clutch member, said driven clutch member having one end and an opposite end, said driven clutch member further having a first circular groove adjacent said one end and a second circular groove adjacent said opposite end;

clutch means, interposed said driving clutch member and said driven clutch member, for providing a rotational coupling therebetween in one direction of rotation and for providing an overrunning coupling therebetween in an opposite direction of rotation;

detent means, mounted on said driven clutch member, for cooperatively engaging said second circular groove to prevent said detent means from withdrawing from said second circular groove below a predetermined rotational speed of the engine, said detent means further cooperatively engaging said first circular groove to prevent said pinion gear from moving axially along said power shaft into mesh with the engine ring when the power shaft is at rest; and means, responsive to the rotation of the power shaft, for axially transversing said pinion gear into mesh with the engine ring gear and for transmitting torque from the power shaft to the engine ring gear so as to crank the engine to be started.

* * * * *

UNITED STATES PATENT AND TRADEMARK OFFICE

CERTIFICATE OF CORRECTION

PATENT NO. : 4,395,923

DATED : August 2, 1982

INVENTOR(S) : Paul F. Giometti

It is certified that error appears in the above-identified patent and that said Letters Patent is hereby corrected as shown below:

Column 1, line 18, before "starter" insert ---- engine ----.

Column 1, line 29, after "is" insert a comma ---- , ----.

Column 1, line 30, after "respect" insert a comma ---- , ----.

Column 1, line 31, delete "a", second occurrence.

Column 1, line 37, delete "and milling a notch".

Column 1, line 62, delete the comma "," both occurrences.

Column 2, line 64, delete the period "." and insert a semi-colon ---- ; ----.

Column 2, line 66, delete the period "." and insert ---- ; and ----.

Column 3, line 15, delete "drawing" and insert ---- driving ----.

UNITED STATES PATENT AND TRADEMARK OFFICE

CERTIFICATE OF CORRECTION

PATENT NO. : 4,395,923

DATED : August 2, 1983

INVENTOR(S) : Paul F. Giometti

It is certified that error appears in the above-identified patent and that said Letters Patent is hereby corrected as shown below:

Column 3, line 26, before "clutch" insert ---- driving ----.

Column 3, line 37, delete "journaled" and insert ---- journalled ----.

Column 3, line 54, after "pinion" insert ---- gear ----.

Column 3, line 55, delete "said" and insert ---- the ----.

Column 3, line 56, before "ring" insert ---- engine ----.

Column 3, line 64, after "pinion" insert ---- gear ----.

Column 3, line 66, delete "driving member 30" and insert ---- driven clutch member 30.

Column 4, line 1, after "pinion" insert ---- gear ----. Same line, before "ring" insert ---- engine ----.

Column 4, line 8, after "pinion" insert ---- gear ----. Same line, before "ring" insert ---- engine ----.

Column 4, line 12, after "pinion" insert ---- gear ----. Same line, before "ring" insert ---- engine ----.

Column 4, line 15, after "pinion" insert ---- gear ----.

Column 4, line 16, before "ring" insert ---- engine ----.

UNITED STATES PATENT AND TRADEMARK OFFICE

CERTIFICATE OF CORRECTION

PATENT NO. : 4,395,923

DATED : August 2, 1983

INVENTOR(S) : Paul F. Giometti

It is certified that error appears in the above-identified patent and that said Letters Patent is hereby corrected as shown below:

Column 4, line 26, before "driven" insert ---- the ----.

Column 4, line 28, before "control", first occurrence, insert ---- the ----.

Column 4, line 30, after "pinion" insert ---- gear ----. Same line, before "ring" insert ---- engine ----.

Column 4, line 34, before "ring" insert ---- engine ----.

Column 4, line 35, after "pinion" insert ---- gear ----.

Column 4, line 40, after "pinion" insert ---- gear ----.

Column 4, line 43, delete "driven" and insert ---- driving ----.

Column 4, line 45, after "pinion" insert ---- gear ----. Same line, before "ring" insert ---- engine ----.

Column 4, line 49, before "ring" insert ---- engine ----. Same line, after "gear 85" insert a comma ---- , ----.

Column 4, line 51, before "ring" insert ---- engine ----.

Column 4, line 54, delete "with respect to" and insert ---- of ----. Same line, delete "driving" and insert ---- driven ----.

UNITED STATES PATENT AND TRADEMARK OFFICE

CERTIFICATE OF CORRECTION

PATENT NO. : 4,395,923

DATED : August 2, 1983

INVENTOR(S) : Paul F. Giometti

It is certified that error appears in the above-identified patent and that said Letters Patent is hereby corrected as shown below:

Column 4, line 58, before "member" (2nd occurr.) insert --driving--

Column 4, line 60, before "straight" insert ---- the ----.

Column 4, line 63, before "clutch" insert ---- driving ----.

Column 5, line 1, delete "and" and insert a comma ---- , ----.

Column 5, line 2, after "pinion" insert ---- gear ----. Same line, before "ring" insert ---- engine ----.

Column 5, line 3, before "coupling" insert ---- clutch ----. Same line, delete "20, 30" and insert ---- 20 and 30 ----.

Column 5, line 10, delete the comma "," and insert ---- and ----.

Claim 1, column 5, line 18, after "drive" insert ---- system ----.

Claim 1, column 5, line 19, after "starter" insert ---- system ----.

Claim 1, column 5, line 37, after "gear" insert ---- member ----.

Claim 1, column 5, line 40, before "ring" insert ---- engine ----.

Claim 1, column 5, line 41, after "gear" insert ---- member ----.

UNITED STATES PATENT AND TRADEMARK OFFICE

CERTIFICATE OF CORRECTION

PATENT NO. : 4,395,923

DATED : August 2, 1983

INVENTOR(S) : Paul F. Giometti

It is certified that error appears in the above-identified patent and that said Letters Patent is hereby corrected as shown below:

Claim 1, column 5, line 42, before "ring", both occurrences, insert ---- engine ----.

Claim 1, column 5, line 44, before "ring", both occurrences, insert ---- engine ----.

Claim 1, column 5, line 45, delete "predeterminate" and insert ---- predetermined ----.

Claim 1, column 5, line 46, after "gear" insert ---- member ----.

Claim 1, column 5, line 47, delete "the" and insert ---- said ----.

Claim 1, column 5, line 48, before "ring" insert ---- engine ----.

Claim 1, column 5, line 52, before "ring" insert ---- engine ----.

Claim 1, column 5, line 55, delete "the" and insert ---- said ----.

Claim 1, column 5, line 56, after "gear" insert ---- member ----.

Claim 1, column 5, line 57, before "ring" insert ---- engine ----.

Claim 1, column 5, line 58, before "ring" insert ---- engine ----.

Claim 1, column 5, line 59, before "ring", both occurrences, insert ---- engine ----.

UNITED STATES PATENT AND TRADEMARK OFFICE

CERTIFICATE OF CORRECTION

PATENT NO. : 4,395,923

DATED : August 2, 1983

INVENTOR(S) : Paul F. Giometti

It is certified that error appears in the above-identified patent and that said Letters Patent is hereby corrected as shown below:

Claim 2, column 5, line 64, after "gear" insert ---- member ----.

Claim 2, column 5, line 65, delete "the" and insert ---- said ----.

Claim 2, column 5, line 67, after "gear" insert ---- member ----.

Claim 2, column 6, line 1, after "gear" insert ---- member ----. Same line, delete "the" and insert ---- said ----.

Claim 2, column 6, line 2, after "gear", second occurrence, insert ---- member ----.

Claim 2, column 6, line 3, delete "the", second occurrence, and insert ---- said ----.

Claim 2, column 6, line 4, delete "permit" and insert ---- permits ----. Same line, after "gear" insert ---- member ----.

Claim 2, column 6, line 5, delete "the" and insert ---- said ----.

Claim 3, column 6, line 31, delete "the" and insert ---- said ----.

Claim 3, column 6, line 35, delete "the" and insert ---- said ----.

Claim 3, column 6, line 36, delete "the" and insert ---- said ----.

Claim 3, column 6, line 41, delete "the" and insert ---- said ----.

UNITED STATES PATENT AND TRADEMARK OFFICE

CERTIFICATE OF CORRECTION

PATENT NO. : 4,395,923

DATED : August 2, 1983

INVENTOR(S) : Paul F. Giometti

It is certified that error appears in the above-identified patent and that said Letters Patent is hereby corrected as shown below:

Claim 3, column 6, line 42, before "ring" insert ---- said engine ----.

Claim 4, column 6, line 47, delete "the" and insert ---- said ----.

Claim 4, column 6, line 49, delete "the", first occurrence, and insert ---- said ----.

Claim 4, column 6, line 50, delete "the" and insert ---- said ----.

Claim 6, column 6, line 63, delete "the" and insert ---- said ----.

Claim 6, column 6, line 64, delete "the" and insert ---- said ----.

Claim 6, column 6, line 67, delete "the" and insert ---- said ----.

Claim 7, column 7, line 6, delete "having" and insert ---- has ----.

Claim 8, column 7, line 25, delete "the" and insert ---- said ----.

Same line, before "ring", second occurrence, insert ---- engine ----.

Claim 8, column 7, line 29, delete "the" and insert ---- said ----.

Claim 8, column 7, line 32, delete "the" and insert ---- said ----.

Claim 8, column 7, line 33, before "ring" insert ---- engine ----.

Claim 8, column 7, line 44, delete "the" and insert ---- said ----.

Claim 8, column 7, line 45, before "ring" insert ---- said engine ----.

UNITED STATES PATENT AND TRADEMARK OFFICE

CERTIFICATE OF CORRECTION

PATENT NO. : 4,395,923

DATED : August 2, 1983

INVENTOR(S) : Paul F. Giometti

It is certified that error appears in the above-identified patent and that said Letters Patent is hereby corrected as shown below:

Claim 9, column 7, line 50, delete "the" and insert ---- said ----.

Claim 9, column 7, line 51, delete "the" and insert ---- said ----.

Claim 9, column 8, line 13, before "ring" insert ---- engine ----.

Claim 9, column 8, line 16, delete "the" and insert ---- said ----.

Claim 9, column 8, line 18, delete "the" and insert ---- said ----.

Claim 9, column 8, line 23, delete "the", first occurrence, and insert ---- said ----.

Claim 10, column 8, line 29, delete "the" and insert ---- said ----.

Claim 10, column 8, line 60, delete "the", second occurrence, and insert ---- said ----.

Claim 10, column 8, line 61, delete "transversing" and insert ---- traversing ----.

UNITED STATES PATENT AND TRADEMARK OFFICE

CERTIFICATE OF CORRECTION

PATENT NO. : 4,395,923

DATED : August 2, 1983

INVENTOR(S) : Paul F. Giometti

It is certified that error appears in the above-identified patent and that said Letters Patent is hereby corrected as shown below:

Claim 10, column 8, line 62, delete "the" and insert ---- said ----.

Claim 10, column 8, line 63, delete "the", both occurrences, and insert ---- said ----, both occurrences.

Signed and Sealed this

*Second* Day of *October 1984*

[SEAL]

*Attest:*

GERALD J. MOSSINGHOFF

*Attesting Officer*

*Commissioner of Patents and Trademarks*